United States Patent [19]

Tank et al.

[11] 4,001,930

[45] Jan. 11, 1977

[54] METHOD FOR REDUCING HARMFUL STRESSES IN LAYERS APPLIED BY THERMAL SPRAYING

[75] Inventors: Eggert Tank, Fellbach; Franz Pigisch, Beutelsbach, both of Germany

[73] Assignee: Daimler-Benz Aktiengesellschaft, Germany

[22] Filed: Dec. 18, 1972

[21] Appl. No.: 316,060

[30] Foreign Application Priority Data

Dec. 17, 1971 Germany ..... 2162700

[52] U.S. Cl. ..... 29/460; 427/277; 427/279; 427/309; 427/423; 29/527.2; 29/445

[51] Int. Cl.[2] ..... B23P 3/20

[58] Field of Search ..... 117/105.2, 93.1 PF, 117/93.1 CD, 46 FS, 8, 47; 427/279, 277, 423, 309; 29/527.2, 460, 445

[56] References Cited

UNITED STATES PATENTS

| | | | |
|---|---|---|---|
| 2,005,897 | 6/1935 | Knowles | 117/105.2 |
| 3,048,061 | 8/1962 | Mele | 117/105.2 |
| 3,247,579 | 4/1966 | Cattermole et al. | 117/93.1 |

FOREIGN PATENTS OR APPLICATIONS

| | | |
|---|---|---|
| 1,300,460 | 7/1969 | Germany |

*Primary Examiner*—Bernard D. Pianalto
*Attorney, Agent, or Firm*—Craig & Antonelli

[57] ABSTRACT

A method for reducing harmful stresses in layers, particularly ceramic layers such as aluminum oxide, chrome oxide or nickel oxide and calcium fluoride applied by thermal spraying on metallic structural parts in which the applied layer is subdivided in planes extending generally perpendicularly to the layer surface by partition members.

36 Claims, No Drawings

METHOD FOR REDUCING HARMFUL STRESSES IN LAYERS APPLIED BY THERMAL SPRAYING

The present invention relates to a method for the reduction of harmful stresses in layers, especially in ceramic layers such as aluminum oxide, chrome oxide or nickel oxide, and calcium fluoride applied by thermal spraying onto metallic structural parts.

Numerous methods of application are possible to apply layers from a number of suitable materials onto parts of other materials.

Thus, for example, materials can be applied by condensing from the vapor phase. Furthermore, the application of a layer by means of a transport by an electric field is also known; this method is generally known as electrophoresis. Additionally, layers to be applied can also be produced by chemical or electro-chemical reactions; in that connection should be mentioned chromating, nitriding, galvanizing and anodic treatment. Furthermore, layers can be applied by the application of metallurgical methods, such as, welding, plating or by a reaction with a metal melt. Finally, the application of layers by purely mechanical means such as immersion and spraying should be mentioned.

As a method of application, in which both a purely mechanical application as also an application by metallurgical process are used in combined form, is to be considered the known method of thermal spraying, which is customarily referred to as flame-spraying.

The aim of the present invention is to improve the properties of flame-sprayed layers.

The principle of this method and its application are generally known. It entails the following advantages:

The method is very versatile and makes it possible to apply a large number of different materials on structural parts which in turn may consist of the most varied materials and may have nearly any shape. A further advantage of the flame-spraying method is the fact that a structural part to be coated is not heated to high temperatures during the process. As a rule, no thermal after-treatment of the structural part is required after the coating.

If the sprayed-on layers or coatings are to be relatively thin, for example, up to an order of magnitude of 0.1 mm., then hardly any difficulties arise during the manufacture of the spray layers as well as during the loading of the structural part and therewith during the loading of the spray layer.

If, however, layer thicknesses of a material to be sprayed-on in the order of magnitude of several tenths of a millimeter or even several millimeters are necessary, then according to experience, great difficulties arise during the manufacture of the layers and during the loading thereof, especially if the latter is of thermal type.

The stresses occurring during the manufacture or arising during loading in a layer of between the layer and the structural part may readily become larger than the forces which hold together the layer, or the forces which hold a layer onto the structural part.

Herein lies a considerable disadvantage of the prior art method, for large layer thicknesses may be necessary, for example, during the application of slide or wear materials, especially on metallic structural parts, and the mentioned materials are subjected as bearing materials frequently to highest and also thermal loads and stresses.

If the materials to be applied and the base supports are of metallic type, then by reason of the generally existing similarity of the physical properties of the base supports and the spray layers to be applied, such great difficulties do not occur during the application as would render completely impossible the manufacture of these parts or their use.

If such materials are, however, of ceramic type, then the difficulties occurring during the manufacture and use of coated structural parts become generally excessively great. The layers tear during the manufacture or they tear off from the base. Even if however, one succeeds to completely manufacture a structural part with the applied layer, then the layers normally fail during use if they are used, for example, as bearing or slide materials.

The manufacture of completely satisfactory ceramic spray layers with layer thicknesses of the order of magnitude of several tenths of a millimeter up to several millimeters, especially on metallic structural parts and the use of such structural parts have therefore been hardly realizable heretofore.

It is the aim and principal object of the present invention to considerably reduce the stresses occurring during the manufacture of applied layers and the stresses occurring during the use of the coated structural parts and in this manner to make possible in the first instance the manufacture and the use of thicker spray layers. The problems underlying the present invention are solved according to the present invention in that the applied layer is subdivided by partition sheet metal members in planes extending perpendicularly to the layer surface. The partition members or sheet metal parts may consist, according to a further feature of the present invention, of iron, nickel, cobalt, or the alloys thereof with chrome, molybdenum, tungsten, aluminum and/or titanium which form webs or walls disposed perpendicularly to the surface to be coated. The partition sheet metal members may thereby be arranged and constructed in such a manner that they enclose surface strips, polygons or circles or any other suitable shapes. The height of the partition members may correspond to the thickness of the layer to be applied subsequently.

The webs may be soldered with a solder on the basis of nickel-boron-silicon to which may be added chrome or iron.

The method according to the present invention may also be applied in a different manner in that the partition sheet metal members are formed by raised portions obtained by milling or by spark erosion or electrochemical removal out of the structural parts themselves.

The webs or walls formed according to the present invention fit and embed themselves during the spraying in the corresponding spray layer as dividing segments. It is essential that the material of the used webs and their presence do not impair the intended effect of the layer to be sprayed-on. In order to obtain this effect, the sheet metal partition members, as mentioned, may consist of iron, nickel or cobalt or of an alloy of these materials with chrome, molybdenum, tungsten, aluminum, and/or titanium and may be soldered with a solder on the basis of nickel-boron-silicon nickel-chrome-boron-silicon or nickel-iron-boron-silicon. It is furthermore essential that the regular or irregular triangular or polygonal or round individual pieces of the spray layer to be sprayed-on, which result from the partition members, do not have any mechanical connection with each other. The arrangement of the webs or walls depends on the specific application which determines the most appropriate shape of the individual pieces of the layer to be sprayed-on. The webs or walls may have a thickness of less than 0.1 mm.; however, they may also be up to several millimeters thick. The height of the webs is appropriately so selected that for achieving the desired thickness of the layer to be sprayed-on, both the spray materials as also the webs are machined in common during the same operating step after the termination of the spraying operation and thus receive the same height as well as the same surface quality.

For purposes of explaining the present invention, the manufacture of one embodiment will be described more fully hereinafter.

The use of a mixture of nickel oxide and calcium fluoride applied by flame-spraying as high temperature sliding material is generally known. This material and its treatment are described in the German Patent No. 1,300,460.

This material has to be sprayed on in several layer thicknesses of about 1–2 mm. thickness, if it is to be effective over longer periods of time together with a structural part or with a sealing structural part which is used, for example, as flange or ring seal.

In order to be able to manufacture such structural parts more readily and with fewer risks, sheet metal members of iron, nickel or cobalt or of an alloy on the basis of these materials are secured according to the present invention as dividers or partitions of the spray layer in the form of webs or walls extending perpendicularly from the surface to be coated. The fastening may take place, for example, by soldering with a solder on the basis of nickel-boron-silicon or nickel-chrome-boron-silicon or nickel-iron-boron-silicon and the sheet metal members may form, for example, a honeycombed pattern. With a high temperature use of the sliding bearing layer, a nickel content of up to 70% is permissive in a slide layer consisting of nickel oxide and calcium fluoride whereby the mentioned percentage is measured with respect to the running or bearing surface. An impairment of the function of the material of the spray layer which consists of nickel oxide and calcium fluoride, therefore does not occur by the webs or walls consisting of the metallic materials of iron, nickel or cobalt or of alloys thereof which are used according to the present invention, even though they are located on the inside of the running or bearing surface as a component part.

In reversal of the method of securing webs or walls on structural parts, recesses may be obtained by cutting or milling or spark erosion or chemical removal in structural parts made of corresponding materials, between which remain webs or walls. These recesses are then sprayed out with slide material so that the completely finished layer does not differ from such a layer whose partition walls are soldered onto a structural part.

The type of seals coated with nickel oxide and calcium fluoride to which the present invention relates, are used as "D"-shaped or circularly shaped seals in heat-exchangers as are used in gas turbines for commercial types of motor vehicles such as trucks. Such heat-exchangers include as heat-exchanging medium a rotating disc of glass-ceramic honeycomb matrix which slides along the seals.

A typical example of the manufacture of such a seal according to the present invention is as follows:

Sheet metal members or plates with a thickness of about 0.01 inch and a width of 0.1 inch are secured as vertically projecting webs on the metallic surface of the seal to be coated with nickel oxide and calcium fluoride as partition members or dividers. These sheet metal partition members consist of a pure, non-alloyed nickel. The fastening takes place by conventional vacuum-soldering at a temperature of 1,150° C. with a solder that essentially consists of about 92.6% by weight of nickel, about 4.5% by weight of silicon and about 2.9% by weight of boron. The sheet metal members are so arranged that they form on the metallic surface a very coarse honeycomb pattern with a mesh width or honeycomb width of about ½ inch.

A nickel-aluminide layer is applied by thermal spraying as adhesive base onto the seal provided with the partitioning sheet metal members. After this coating, nickel oxide and calcium fluoride are applied by thermal spraying in a layer thickness of about 0.1 inch. After this operation, the coated structural part is ground off by an amount of about 0.01 inches to about 0.02 inches.

With the use of the thus ground seals in truck-heat-exchangers, an impairment of the functioning of the materials of the spray layer due to the presence of the nickel sheet metal members does not occur since the sheet metal members oxidize at their freely exposed surface under the high temperatures prevailing in the heat-exchanger into nickel oxide and consequently again only nickel oxide and calcium fluoride are present in the bearing surface or slide surface.

While the foregoing example utilizes partition sheet metal members of pure nickel, they may also consist of pure iron or pure cobalt or the alloys thereof, i.e., the alloys of nickel, iron or cobalt, especially with chrome or molybdenum or aluminum and/or titanium. The alloys of iron, nickel or cobalt with the mentioned alloying metals may contain about 5 to about 30% by weight of chrome, about 5 to about 30% by weight of molybdenum, about 1 to about 10% by weight of tungsten, 0 to about 6% by weight of aluminum, and/or 0 to about 5% by weight of titanium, either individually or in common.

The solder by means of which the webs are fastened onto the base may be a conventional solder on the basis of nickel-boron-silicon to which may be added also chrome or iron. These solders on the basis of nickel may contain 0 to about 10% by weight of silicon, 0 to about 5% by weight of boron, 0 to about 20% by weight of chrome, or 0 to about 5% by weight of iron, the remainder essentially nickel.

As a result of the provided webs or walls, the individual pieces of the sprayed-on layer can no longer exert any forces directly on one another whereby, however, it should be noted that the realized webs or walls are securely connected with the structural part, i.e., with the surface thereof to be sprayed or are worked out of the surface at this location as a part of the structural part.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

What we claim is:

1. A method for reducing harmful stresses in at least one layer applied on a metallic structural part by thermal spraying, which at least one layer has a thickness which causes the harmful stresses, comprising the step of providing partition members on said metallic structual part to subdivide the at least one layer applied in planes extending perpendicularly to the surface of the metallic structural part so as to reduce the harmful effects of such stresses.

2. A method according to claim 1, characterized in that the applied layers are ceramic layers.

3. A method according to claim 2, characterized in that the ceramic layers are aluminum oxide, chrome oxide or nickel oxide and calcium fluoride.

4. A method according to claim 3, characterized in that the partition members consist of a material selected from a group consisting of iron, nickel, cobalt and alloys thereof, which forms webs or walls disposed substantially perpendicularly on the surface of said metallic structural part to be coated.

5. A method according to claim 3, characterized in that the partition members consist of a material selected from a group consisting of iron, nickel, cobalt, and alloys thereof with at least one material selected from a group consisting of chrome, molybdenum, tungsten, aluminum and titanium.

6. A method according to claim 5, characterized in that the amounts of alloying material in the alloys of iron, nickel and cobalt which may be contained therein either individually or in common, are about 5 to about 30% by weight of chrome, about 5 to about 30% by weight of molybdenum, about 1 to about 10% by weight of tungsten, 0 to about 6% by weight of aluminum and 0 to about 5% by weight of titanium.

7. A method according to claim 1, characterized in that the partition members enclose area strips.

8. A method according to claim 1, characterized in that the partition members enclose polygons.

9. A method according to claim 1, characterized in that the partition members enclose circles.

10. A method according to claim 1, characterized in that the webs are soldered on with a solder on the basis of nickel-boron-silicon.

11. A method according to claim 10, characterized in that either chromium or iron is also added to the solder.

12. A method according to claim 11, characterized in that the solder on the basis of nickel may contain 0 to about 10% by weight of silicon, 0 to about 5% by weight of boron, 0 to about 20% by weight of chrome, or 0 to about 5% by weight of iron.

13. A method according to claim 12, characterized in that the partition members consist of a material selected from a group consisting of iron, nickel, cobalt, and alloys thereof with at least one material selected from a group consisting of chrome, molybdenum, tungsten, aluminum and titanium.

14. A method according to claim 13, characterized in that the amounts of alloying material in the alloys of iron, nickel and cobalt which may be contained therein either individually or in common, are about 5 to about 30% by weight of chrome, about 5 to about 30% by weight of molybdenum, about 1 to about 10% by weight of tungsten, 0 to about 6% by weight of aluminum and 0 to about 5% by weight of titanium.

15. A method according to claim 14, characterized in that the height of the partition members corresponds substantially to the thickness of the layer to be applied.

16. A method according to claim 15, characterized in that the applied layers are ceramic layers.

17. A method according to claim 16, characterized in that the ceramic layers are aluminum oxide, chrome oxide or nickel oxide and calcium fluoride.

18. A method according to claim 1, characterized in that the height of the partition members corresponds sustantially to the thickness of the layer to be applied.

19. A method according to claim 1, characterized in that the partition members are formed by raised portions integral with and of the same material as the structural parts, which are obtained by removing material from the structural parts.

20. A method according to claim 19, characterized in that the raised portions are obtained by milling.

21. A method according to claim 19, characterized in that the raised portions are obtained by spark-erosion.

22. A method according to claim 19, characterized in that the raised portions are obtained by chemical removal.

23. A method for reducing harmful stresses in an applied layer on a metallic structural part comprising:

providing metal partition members of up to several millimeters thickness on the part to extend transversely through a layer to be applied, and flame-spraying a ceramic layer of at least several tenths of a millimeter thickness onto the metallic structural part on which said partition members have been provided so as to reduce harmful effects of the stresses.

24. The method of claim 23, wherein the partition members are arranged to subdivide the ceramic layer into individual pieces so that no pieces have any mechanical connection with each other.

25. The method of claim 23, wherein the partition members and the ceramic layer have substantially equal heights.

26. The method of claim 25, wherein the partition members intersect with one another to enclose polygons.

27. The method of claim 25, wherein the partition members intersect to enclose circles.

28. The method of claim 23, wherein the ceramic layer is aluminum oxide, chrome oxide or nickel oxide and calcium fluoride.

29. The method of claim 28, wherein the partition members consist of a material selected from a group consisting of iron, nickel, cobalt and alloys thereof which form webs or walls disposed substantially perpendicularly on the surface to be coated.

30. The method of claim 28, wherein the partition members consist of a material selected from a group consisting of iron, nickel, cobalt and alloys thereof with at least one material selected from a group consisting of chrome, molybdenum, tungsten, aluminum and titanium.

31. The method of claim 23, wherein the partition members are soldered on with a solder on the basis of nickel-boron-silicon.

32. The method of claim 31, wherein either chromium or iron is also added to the solder.

33. The method of claim 23, wherein the partition members are formed by raised portions integral with and of the same material as the structural part, which are obtained by removing material from the structural part.

34. The method of claim 23, wherein the partition members consist of a material selected from a group consisting of iron, nickel, cobalt and alloys thereof with at least one material selected from a group consisting of chrome, molybdenum, tungsten, aluminum and titanium.

35. The method of claim 23, wherein the metallic structural part and applied layer form an integral member.

36. The method of claim 23, wherein the partition members are bonded to the structural part.

* * * * *